United States Patent [19]

Kobayashi

[11] 4,270,952

[45] * Jun. 2, 1981

[54] PROCESS FOR PREPARING TITANIUM CARBIDE-TUNGSTEN CARBIDE BASE POWDER FOR CEMENTED CARBIDE ALLOYS

[76] Inventor: Yoshinobu Kobayashi, 3599-73, Honmachida, Machida-shi, Tokyo, Japan

[ * ] Notice: The portion of the term of this patent subsequent to May 30, 1995, has been disclaimed.

[21] Appl. No.: 918,946

[22] Filed: Jun. 26, 1978

[30] Foreign Application Priority Data

Jul. 1, 1977 [JP] Japan ..... 52-79394

[51] Int. Cl.[3] ..... B22F 3/00; C22C 29/00

[52] U.S. Cl. ..... 75/203; 75/204; 75/213

[58] Field of Search ..... 75/203, 204, 213

[56] References Cited

U.S. PATENT DOCUMENTS

| | | | |
|---|---|---|---|
| 3,525,999 | 8/1970 | Benesovsky et al. | 75/203 |
| 3,737,289 | 6/1973 | Rudy | 75/203 |
| 4,092,156 | 5/1978 | Kobayashi | 75/204 |
| 4,097,275 | 6/1978 | Horvath | 75/203 |

FOREIGN PATENT DOCUMENTS 52-142698 11/1977 Japan .

*Primary Examiner*—Brooks H. Hunt
*Attorney, Agent, or Firm*—Larson & Taylor

[57] ABSTRACT

A process comprises the steps of molding a mixture of usual TiC powder material having a combined carbon content lower than the theoretical value, a required amount of binder metal and a suitable amount of WC powder, sintering the molded mixture at a high temperature of about 1550° to 2500° C. to dissolve the WC particles in the TiC particles, and maintaining the sintered product at the high temperature, whereby the combined carbon content is increased to the highest possible value approximate to the theoretical value and the binder metal is fully effectively fused to the surface of the TiC particles. The resulting product is readily crushable to a powder having greatly improved amenability to sintering.

6 Claims, No Drawings

PROCESS FOR PREPARING TITANIUM CARBIDE-TUNGSTEN CARBIDE BASE POWDER FOR CEMENTED CARBIDE ALLOYS

The present invention relates to a novel process for preparing titanium carbide-tungsten carbide base (TiC-WC base) powders for the production of cemented carbide alloys.

Conventionally, cemented carbide alloy machines, tools and abrasion-resistant parts are produced by press-molding a powder composition such as WC-Co base, WC-TiC-TaC base or like composition and sintering the resulting molded mass by powder metallurgy techniques.

However, since tungsten is heavier than other metals, the product prepared therefrom is difficult to handle and install. Further because of the limited availability of the tungsten ore, cemented carbide alloys produced therefrom are very expensive.

Titanium appears to be free of these problems and serviceable as a substitute for tungsten used as a base metal of cemented carbide alloys. For use in place of tungsten or for conjoint use therewith as a material of cemented carbides, titanium must be converted to titanium carbide. For this purpose, three methods are known: a first method in which $TiO_2$ is reduced directly with carbon, a second method in which $TiH_2$ is carbonized with addition of carbon, and a third method which is the so called "menstruum process." With the first method, the higher the temperature at which $TiO_2$ is treated in a high degree of vacuum, the higher will be the content of combined carbon in the resulting TiC, but titanium oxide is produced during the reducing process in the form of a eutectic mixture, i.e. TiC-TiO, which is very difficult to reduce. Similarly, the second method involves the formation of a TiC-Ti eutectic mixture which is very difficult to carbonize. According to the third method, Ti is reduced in a bath of low-melting reducing metal such as aluminum. In the course of the reduction, Ti reacts with carbon mixed therewith or with the carbon contained in the reaction vessel itself, forming TiC crystals. The titanium carbide obtained by this method has a combined carbon content most approximate to the theoretical value. However, whichever of the foregoing methods is resorted to, the combined carbon content of TiC industrially available at present is limited to 19.2 to 19.6% which is lower than the theoretical value of 20.05%.

Thus it is very difficult to produce highly pure TiC having a combined carbon content approximately equal to the theoretical value. In other words, titanium carbide heretofore available contains a relatively large amount of free carbon. As a result, TiC-TiO, TiC-Ti or like eutectic mixture reacts with the nickel or cobalt binder used, forming a double carbide phase, seriously reducing the binding effect of the binder metal. Moreover, TiC particles having a highly reactive surface tend to undergo oxidation on the surface, failing to combine with the binder metal with high bond strength. Accordingly although sintered alloys prepared from TiC particles can be harder than WC base alloys, they have lower flexural strength and lower toughness than WC base alloys. The TiC particles produced by the foregoing methods fail to give alloys having the properties required of cemented carbide alloy machines, tools and abrasion-resistant parts.

Various other attempts have also been made for the development of TiC base cemented carbide alloys. The TiC-$Mo_2$-Ni base alloy developed by Ford Company of U.S. in 1964 is known to have high hardness of 90.5 in terms of Rockwell A hardness, but the flexural strength of the alloy is as low as 60 to 120 kg/mm$^2$, thus failing to fulfill the requirement for use as a cemented carbide alloy. Presumably, the inferior properties are attributable to the fact that the TiO and Ti contained in the TiC component impair the properties of Ni used as a binder and also to the presence of an oxide which is formed on the surface of TiC particles during sintering and handling and which prevents effective bonding between the TiC particles with the Ni binder. Because of these problems, hardly any progress has been made ever since in the development of and research on TiC-Ni or -Co base cemented carbide alloys.

I developed a process for preparing titanium carbide base powders for the production of cemented carbide alloys in order to overcome the drawbacks of the conventional processes described and achieved good results. The process comprises the steps of molding a mixture of TiC powder starting material and an amount of binder metal powder required for sintering the TiC material, the TiC material having a combined carbon content lower than the theoretical value; sintering the molded mixture by heating the mixture at a high temperature under conditions inert to TiC; maintaining the sintered product at the high temperature to fully remove the resulting oxide from the surface of the TiC particles and to thereby render the TiC particles highly compatible with the binder metal, causing the binder metal to fuse onto the surface of the TiC particles while permitting the binder metal to form pores by its partial pressure within the resulting binder metal phase of the sintered product; and crushing the sintered product after cooling the product to thereby obtain a powder composed of TiC particles having the highest possible content of combined carbon approximate to the theoretical value, provided with binder metal fused to the surface of the particles with high strength and exhibiting high amenability to sintering.

The present invention is an improvement over the above-mentioned process which has the drawbacks that the titanium carbide base powder obtained is not fully satisfactory in the thermal conductivity of the titanium carbide particles and gives cemented carbide alloys having low strength against pressure. The invention relates to a novel process for preparing titanium carbide-tungsten carbide base powders for the production of cemented carbide alloys which process has been accomplished based on extensive research I have carried out in order to substantially overcome the drawbacks.

The main object of this invention is to provide titanium carbide-tungsten carbide base powders for the production of cemented carbide alloys which are lightweight, easy to handle and inexpensive to manufacture, with use of a greatly reduced amount of tungsten which is heavy and expensive because of the limited resource.

Another object of this invention is to provide titanium carbide-tungsten carbide base powders of remarkably improved sintability for the production of cemented carbide alloys wherein the oxide covering the surface of TiC particles has been removed to the greatest possible extent and which contain TiC having a high content of combined carbon approximate to the theoretical value, the titanium carbide particles thus being rendered very compatible with a binder metal so as to give cemented carbode alloys fulfilling the desired requirements in respect of hardness, flexural strength and toughness.

Another object of this invention is to provide titanium carbide-tungsten carbide base powders for the production of cemented carbode alloys in which powders WC particles have been dissolved in TiC particles, giving improved thermal conductivity to the TiC particles to prevent the retention of heat within the TiC particles and to thereby impart increased heat resistance and enhanced durability to the cemented carbide alloy products to be prepared from the powder, the TiC particles further having improved strength against pressure to give greatly increased pressure resistance to the alloy products.

A further object of this invention is to provide titanium carbide-tungsten carbide base powders which can be manufactured with ease because an intermediate product thereof obtained by sintering the starting material in the course of production is readily crushable.

The process of this invention for preparing a titanium carbide-tungsten carbide base powder for cemented carbide alloys comprises the steps of molding a mixture of TiC powder starting material, an amount of binder metal powder required for sintering the TiC material and a suitable amount of WC powder, the TiC material having a combined carbon content lower than the theoretical value; sintering the molded mixture by heating the mixture at a high temperature of 1550° to 2500° C. under conditions inert to TiC and WC; maintaining the sintered product at the high temperature to dissolve the WC particles in the TiC particles thereby giving improved thermal conductivity and improved strength against pressure to the TiC particles, to fully remove the resulting oxide from the surface of the TiC particles and to thereby render the TiC particles highly compatible with the binder metal, causing the binder metal to fully fuse onto the surface of the TiC particles while permitting the binder metal to form pores by its partial pressure within the resulting binder metal phase of the sintered product; and crushing the sintered product after cooling the product to thereby obtain a powder composed of TiC particles having the highest possible content of combined carbon approximate to the theoretical value, provided with the binder metal fused to the surface of the particles with high strength and exhibiting high amenability to sintering.

The TiC powder used as the starting material is one commercially available and having a lower combined carbon content than the theoretical value. With this invention, the combined carbon content of the powder can be as low as about 18.00%. Useful TiC powders include a mixture of Ti powder and an amount of carbon required for preparing TiC.

The WC powder to be dissolved in the TiC particles also serves to accelerate the sintering reaction like $Mo_2C$, TaC, NbC, etc. In view of the main object of this invention, i.e. economy and the lightness to be given to cemented carbide alloy products, it is preferable to use the WC powder in the TiC to WC ratio of 35–70:65–30 by weight.

Examples of useful binder metals are those generally used; e.g. Ni and Co which are used alone or in mixture. The binder metals, whether used singly or in admixture, can be used in such an amount that the ratio of the amount of the binder metal to the combined amount of the TiC and WC starting powders is 40–10:60–90, most preferably 25–15:75–85, by weight. Usually the binder metal is thoroughly mixed with the TiC and WC powders in a ball mill for a prolonged period of time. Small amounts of TaC and NbC can be added, either singly or in admixture, to the resulting mixture. The use of such materials gives still higher thermal conductivity and pressure resistance to the TiC particles and further promotes the sintering reaction. The resulting mixture is usually press-molded with use of a mold, but the use of the mold is not critical; for example the mixture may be manually molded. The molded mixture is then sintered by being heated at a high temperature of 1550° to 2500° C. under conditions inert to TiC and WC, namely in a vacuum or in an argon gas, nitrogen gas or like inert gas atmosphere. Experiments have revealed that the most preferable sintering temperature is about 2200° C.

With this invention, the heat treatment is not discontinued immediately after the molded mixture has been sintered, but the sintered product is continuously maintained at a temperature within the foregoing range for a period of time which is variable with the heating temperature. Generally the sintered product is maintained at the above-mentioned temperature for a period of time required to dissolve the WC particles in the TiC particles and to fully deoxidize the surface of the TiC-WC solid solution particles, causing the binder metal to firmly fuse onto the surface, and to increase the combined carbon content of the TiC to the highest possible value close to the theoretical value, while permitting part of the binder metal phase precipitated out in the sintered product to vaporize and form pores in the metal phase due to the partial pressure of the metal.

According to this invention, the high-temperature heat treatment causes the WC particles to dissolve into the TiC particles, the main powder starting material, giving improved thermal conductivity to the TiC particles to prevent the retention of heat within the TiC particles and to thereby impart increased heat resistance and enhanced durability to the cemented carbide alloy products to be prepared from the powder, the TiC particles further having improved strength against pressure to give greatly increased pressure resistance to the alloy products.

The high-temperature heat treatment serves to remove oxide from the surface of the TiC particles to the greatest possible extent and also to increase the combined carbon content of the TiC nearly to the theoretical value, whereby the TiC particles are rendered highly compatible with the binder metal, enabling the binder metal to fuse to the surface of the TiC particles with high strength. Consequently the titanium carbide-tungsten carbide base powder obtained by the present process is much more amenable to sintering than the powders of the same type heretofore available, with the resulting advantage that the cemented carbide alloys prepared from the powder by re-sintering are superior in durability since they have the hardness and the strength against pressure required of cemented carbide alloys as well as satisfactory flexural strength and good thermal conductivity and are therefore well-suited for the manufacture of cemented carbide alloy machines, tools and various wear-resistant parts. This invention has another advantage that the sintered product obtained is readily crushable to the desired powder due to the presence of the pores which are formed by vaporizing part of the binder metal phase of the sintered body through the high-temperature treatment.

Examples of this invention are given below.

EXAMPLE 1

To 45% by weight of TiC powder starting material comprising commercial TiC powder (containing 19.7% by weight of combined carbon and 0.1% by weight of free carbon) and 0.55% by weight of carbon added to the TiC powder was added 35% by weight of WC powder and 20% by weight of carbonyl nickel as Ni, the ingredients were mixed together in a ball mill for 48 hours, and the mixture was pressed in a mold. The molded mixture was then heated for sintering at 1500° C. in a vacuum furnace to obtain a test piece, which was found to have the following properties.

Strength against pressure: 480 kg/mm$^3$.

Hardness, Rockwell A: 90.2.

Free carbon in the sintered product: Corresponding to ASTM C4.

Pores in the sintered product: Corresponding to ASTM B4.

Thus the test piece had low strength against pressure and poor thermal conductivity because the TiC particles and the WC particles were not in the form of a complete solid solution but remained a mixture.

Accordingly, the test piece was then heated at about 2400° C. for 1 to 1.5 hours in an argon gas atmosphere which is inert to TiC and WC, causing the WC particles to completely dissolve in the TiC particles and part of the nickel phase in the TiC-WC solid solution to vaporize and produce pores. The resulting product was readily crushable due to the presence of the pores. The TiC-WC solid solution particles obtained had a combined carbon content approximate to the theoretical value, was substantially free of oxide on their surface and had Ni fused to the surface with high bond strength.

To 93.7% by weight of the TiC-WC-Ni powder (20% by weight of Ni and 1.6μ in particle size) were added 6.0% by weight of Ni and 0.3% by weight of C, the ingredients were mixed together in a ball mill for 24 hours, and the mixture was pressed in a mold with use of paraffin wax as a binder-lubricant. The molded product was then dewaxed by being heated to 1200° C. and thereafter heated at 1400° C. in a vacuum furnace for sintering. The sintered product was found to have the following properties.

Strength against pressure: 880 kg/mm$^3$.

Hardness, Rockwell A: 89.80.

Free carbon in the sintered product: Corresponding to ASTM C2.

Pores in the sintered product: Corresponding to ASTM A1.

Thus the test piece had greatly improved strength against pressure and had a good thermal conductivity.

When the above procedures were repeated in the same manner as above except that 20% by weight of Ni was replaced by 20% by weight of Co, or by equal amounts of Ni and Co, substantially the same results as above were obtained.

EXAMPLE 2

To 55% by weight of TiC powder starting material comprising commercial TiC powder (containing 19.6% by weight of combined carbon and 0.3% by weight of free carbon) and 0.45% by weight of carbon added to the TiC powder were added 25% by weight of WC powder and 20% by weight of carbonyl nickel as Ni. The ingredients were mixed together and molded in the same manner as in Example 1. The molded mixture was then heated for sintering at 1520° C. in a vacuum furnace to obtain a test piece, which was found to have the following properties.

Strength against pressure: 384 kg/mm$^3$.

Hardness, Rockwell A: 89.6.

Thus the test piece had low strength against pressure and poor thermal conductivity for the same reason as in Example 1.

The test piece was then heated at a progressively increasing temperature of from about 1500° to 1700° C. and finally heated to about 2200° C. The heating was continued for 1 to 1.5 hours in a nitrogen gas atmosphere which is inert to TiC and WC, causing the WC particles to completely dissolve in the TiC particles and part of the nickel phase in the TiC-WC solid solution to vaporize and produce pores, whereby a skeletal product was obtained. The product was readily crushable due to the presence of the pores. The TiC-WC solid solution particles obtained had a combined carbon content approximate to the theoretical value, was substantially free of oxide on their surface and had Ni completely fused to the surface.

To 94.75% by weight of the TiC-WC-Ni powder were added 5% by weight of Ni and 0.25% by weight of C, the ingredients were mixed together in a ball mill for 24 hours, and the mixture was pressed in a mold with use of paraffin wax as a binder-lubricant. The molded product was then dewaxed by being heated to 1150° C. and thereafter heated at 1470° C. in a vacuum furnace for sintering. The sintered product was found to have the following properties.

Strength against pressure: 784 kg/mm$^3$.

Hardness, Rockwell A: 88.20.

Free carbon in the sintered product: Corresponding to ASTM C2.

Pores in the sintered product: Corresponding to ASTM A1.

Thus the test piece had greatly improved strength against pressure and had a good thermal conductivity.

I claim:

1. A process for preparing a titanium carbide-tungsten carbide base powder for cemented carbide alloys comprising the steps of molding a mixture of TiC powder starting material, an amount of binder metal powder required for sintering the TiC material and WC powder in an amount of 65–30 parts by weight per 35–70 parts by weight of TiC, the TiC material having a combined carbon content lower than the theoretical value; sintering the molded mixture by heating the mixture at a high temperature of 1550° to 2500° C. under conditions inert to TiC and WC to dissolve the WC particles in the TiC particles; maintaining the sintered product at the high temperature to fully remove the resulting oxide from the surface of the TiC particles and to thereby render the TiC particles highly compatible with the binder metal, causing the binder metal to fully fuse onto the surface of the TiC particles while permitting the binder metal to form pores by its partial pressure within the resulting binder metal phase of the sintered product; and crushing the sintered product after cooling the product to thereby obtain a powder composed of TiC particles having the highest possible content of combined carbon approximate to the theoretical value, provided with the binder metal fused to the surface of the particles with high strength and exhibiting high amenability to sintering.

2. A process as defined in claim 1 wherein the binder metal is nickel.

3. A process as defined in claim 1 wherein the binder metal is cobalt.

4. A process as defined in claim 1 wherein the binder metal is a mixture of nickel and cobalt.

5. A process for preparing a titanium carbide-tungsten carbide base powder for cemented carbide alloys comprising the steps of molding a mixture of TiC powder starting material, an amount of binder metal powder required for sintering the TiC material, WC powder in an amount of 65–30 parts by weight per 35–70 parts by weight of TiC, and a sintering reaction accelerating agent, the TiC material having a combined carbon content lower than the theoretical value; sintering the molded mixture by heating the mixture at a high temperature of 1550° to 2500° C. under conditions inert to TiC and WC to dissolve the WC particles in the TiC particles; maintaining the sintered product at the high temperature to fully remove the resulting oxide from the surface of the TiC particles and to thereby render the TiC particles highly compatible with the binder metal, causing the binder metal to fuse onto the surface of the TiC particles while permitting the binder metal to form pores by its partial pressure within the resulting binder metal phase of the sintered product; and crushing the sintered product after cooling the product to thereby obtain a powder composed of TiC particles having the highest possible content of combined carbon approximate to the theoretical value, provided with the binder metal fused to the surface of the particles with high strength and exhibiting high amenability to sintering.

6. A process as defined in claim 5 wherein the sintering reaction accelerating agent is $Mo_2C$, TaC or NbC.

* * * * *